US008247752B2

(12) United States Patent
McNamee et al.

(10) Patent No.: US 8,247,752 B2
(45) Date of Patent: Aug. 21, 2012

(54) COMBINATION COOKING APPLIANCE INCLUDING MULTIPLE MICROWAVE HEATING UNITS WITH ROTATABLE ANTENNAE

(75) Inventors: Robert McNamee, Iowa City, IA (US); Thomas Miller, Kalona, IA (US)

(73) Assignee: ACP, Inc., Cedar Rapids, IA (US)

( * ) Notice: Subject to any disclaimer, the term of this patent is extended or adjusted under 35 U.S.C. 154(b) by 628 days.

(21) Appl. No.: 12/248,657

(22) Filed: Oct. 9, 2008

(65) Prior Publication Data

US 2009/0090707 A1 Apr. 9, 2009

Related U.S. Application Data

(60) Provisional application No. 60/960,659, filed on Oct. 9, 2007.

(51) Int. Cl.
*H05B 6/72* (2006.01)
*H05B 6/74* (2006.01)

(52) U.S. Cl. ..... 219/749; 219/751

(58) Field of Classification Search ..... 219/748, 219/749, 750, 745, 756, 751, 746, 747
See application file for complete search history.

(56) References Cited

U.S. PATENT DOCUMENTS 2,593,067 A * 4/1952 Spencer ..... 219/750
3,364,331 A * 1/1968 Johnson ..... 219/746
4,133,997 A * 1/1979 Thuleen ..... 219/748
4,335,290 A 6/1982 Teich
4,456,806 A 6/1984 Arimatsu
4,480,164 A 10/1984 Dills
4,940,869 A 7/1990 Scholtes et al.
5,177,333 A * 1/1993 Ogasawara ..... 219/601
5,981,928 A 11/1999 Lee
5,990,466 A 11/1999 McKee et al.
5,998,775 A * 12/1999 Sung ..... 219/751
6,008,483 A 12/1999 McKee et al.
6,091,057 A 7/2000 Asami et al.
6,576,879 B1 6/2003 Hoh
6,874,495 B2 4/2005 McFadden
6,930,294 B2 8/2005 Kim
7,055,518 B2 6/2006 McFadden et al.
7,235,763 B2 6/2007 Christiaansen et al.
2006/0102864 A1 * 5/2006 Bria et al. ..... 251/129.13
2006/0157479 A1 7/2006 Claesson et al.
2006/0289534 A1 12/2006 Kim et al.

* cited by examiner

*Primary Examiner* — Henry Yuen
*Assistant Examiner* — Hung D Nguyen
(74) *Attorney, Agent, or Firm* — Diederiks & Whitelaw, PLC

(57) ABSTRACT

A microwave cooking appliance includes first and second side mounted microwave systems, each including an associated antenna. Drive structure is provided to establish an oscillating operation for each of the antennae, wherein the angles through which the antennae rotate are configured to assure that the cooking appliance operates in favorable mode patterns. In accordance with the invention, the antenna preferably only oscillates through less than or equal to 180° and, most preferably, approximately 150°.

11 Claims, 4 Drawing Sheets

COMBINATION COOKING APPLIANCE INCLUDING MULTIPLE MICROWAVE HEATING UNITS WITH ROTATABLE ANTENNAE

CROSS-REFERENCE TO RELATED APPLICATIONS

The present application claims the benefit of U.S. Provisional Patent Application Ser. No. 60/960,659 entitled "Combination Cooking Appliance Including Multiple Microwave Heating Units with Rotatable Antennae" filed Oct. 9, 2007.

BACKGROUND OF THE INVENTION

1. Field of the Invention

The present invention pertains to the art of cooking appliances and, more particularly, to a compact cooking appliance capable of combining multiple heating systems, including multiple microwave units, to perform cooking operations.

2. Discussion of the Prior Art

There exists a wide range of cooking appliances on the market. Many of these cooking appliances are designed for use in cooking various types of food products in different ways. For instance, where more conventional cooking appliances generally relied upon radiant energy as the sole heat source, more recent trends combine a radiant heat source with convection or microwave heating techniques, thereby increasing the versatility of the cooking appliance while potentially shortening required cook times. In particular, the prior art contains many examples of at least appliances that combine radiant and convection cooking, as well as combination convection and microwave cooking, techniques.

Regardless of the existence of these known arrangements, there still exists a need for a cooking appliance that employ multiple heating techniques in an efficient and effective manner to handle a wide range of food items. Particularly, there exists a need for a cooking appliance that can be used to rapidly prepare food products that require numerous different heat sources for full and complete cooking in an expedited manner. For example, the rapid preparation of commercially produced, open-faced grilled sandwiches raises various cooking concerns. Open-faced grilled sandwiches generally require, at the very least, that heat be directed both downward onto an upper portion of the sandwich and upward onto a lower bun portion of the sandwich. In most cases this is accomplished by passing the open-faced sandwich on a conveyor belt through an oven between opposing radiant heat sources. While effective to a degree, the process can be time consuming and really does not result in a uniform heating of the meat, cheese and/or other toppings on the bread, nor an even toasting of the bread itself.

In addition, a dual radiant oven of the type described above is simply not suitable for many other applications. For instance, an additional microwave oven or the like would typically be employed to heat soup or other liquid-based food items. To address this and other concerns, it has also been proposed in the prior art to combine each of radiant, convection and microwave energy sources in a compact, versatile cooking appliance. Such a prior art arrangement is disclosed, for example, in U.S. Pat. No. 7,235,763. Whether used alone or with other heat sources, microwave ovens raise various concerns. One concern in particular is the ability of the microwaves to be evenly distributed to avoid hot and cold spotting. To address this concern in microwave ovens, it is customary to have a device that functions to randomize or mix the microwave fields to even out the heating pattern. In practice this is usually done with something that physically rotates, either a stirrer, antenna or even a turntable to act to mix up the microwave fields. Regardless of these known arrangements, improvements in this field would be desirable.

SUMMARY OF THE INVENTION

The present invention is directed to a microwave cooking appliance including multiple microwave heating units, each of which incorporates a rotatable antenna for microwave distribution purposes. In accordance with the most preferred embodiment of the invention, the cooking appliance actually constitutes a combination cooking appliance including an oven cavity having top, bottom and opposing side walls, a door for selectively accessing the oven cavity, at least one radiant heating element exposed to the cooking chamber, a blower having a convection fan, an additional convection heating element directly exposed to an airflow generated by the convection fan and the multiple microwave heating units having associated, rotatable antennae. Behind a rear plate for the oven cavity is established an air return plenum portion for directing a return flow of air from the oven cavity to the blower. The cooking appliance also includes a discharge plenum portion which extends above the oven cavity enabling a convection air stream to flow from the convection fan, across a catalyst and into the oven cavity through a plurality of downwardly exposed nozzles. An exhaust tube opens to the discharge plenum. The exhaust air merges with a cooling air stream established in the cooking appliance about the oven cavity, while additional fresh intake air directly enters the oven cavity about the door.

The present invention is particularly concerned with the microwave aspect of the cooking appliance, particularly controlling the rotation of each of the antennae. More specifically, the invention is concerned with the structure and operation of the antennae wherein the angles through which the antennae rotate are configured to assure that the cooking appliance operates in favorable mode patterns. Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
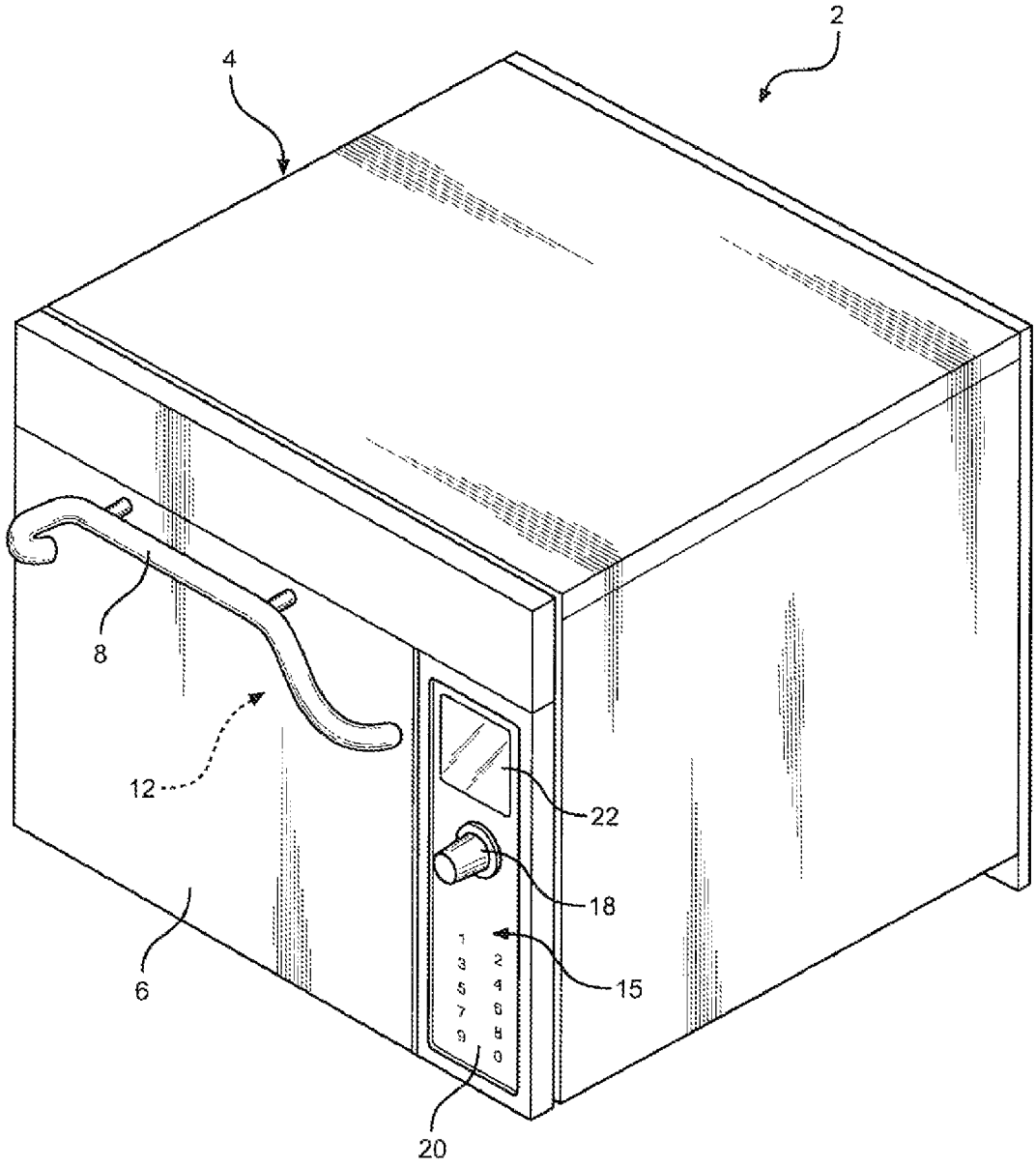
FIG. 1 is an upper right perspective view of a cooking appliance incorporating a combination heating system constructed in accordance with the present invention.

With initial reference to FIG. 1, a cooking appliance constructed in accordance with the present invention is generally indicated at 2. As will be discussed more fully below, cooking appliance 2 constitutes a combination cooking appliance which preferably employs radiant, convection and microwave heating techniques to rapidly and effectively cook a wide range of food items. As shown, cooking appliance 2 includes a cabinet 4 and a door 6 that is provided with a handle 8. In the preferred embodiment shown, door 6 is pivotally mounted about a lower horizontal axis such that handle 8 can be utilized to open door 6 in order to access an internal oven cavity 12. However, a vertical pivoting arrangement, or another type of door opening system, could be readily employed. Cooking appliance 2 also includes a programming interface 15 which is shown to include a control knob 18, a key pad 20 and a touch pad display 22.

Figure 2:
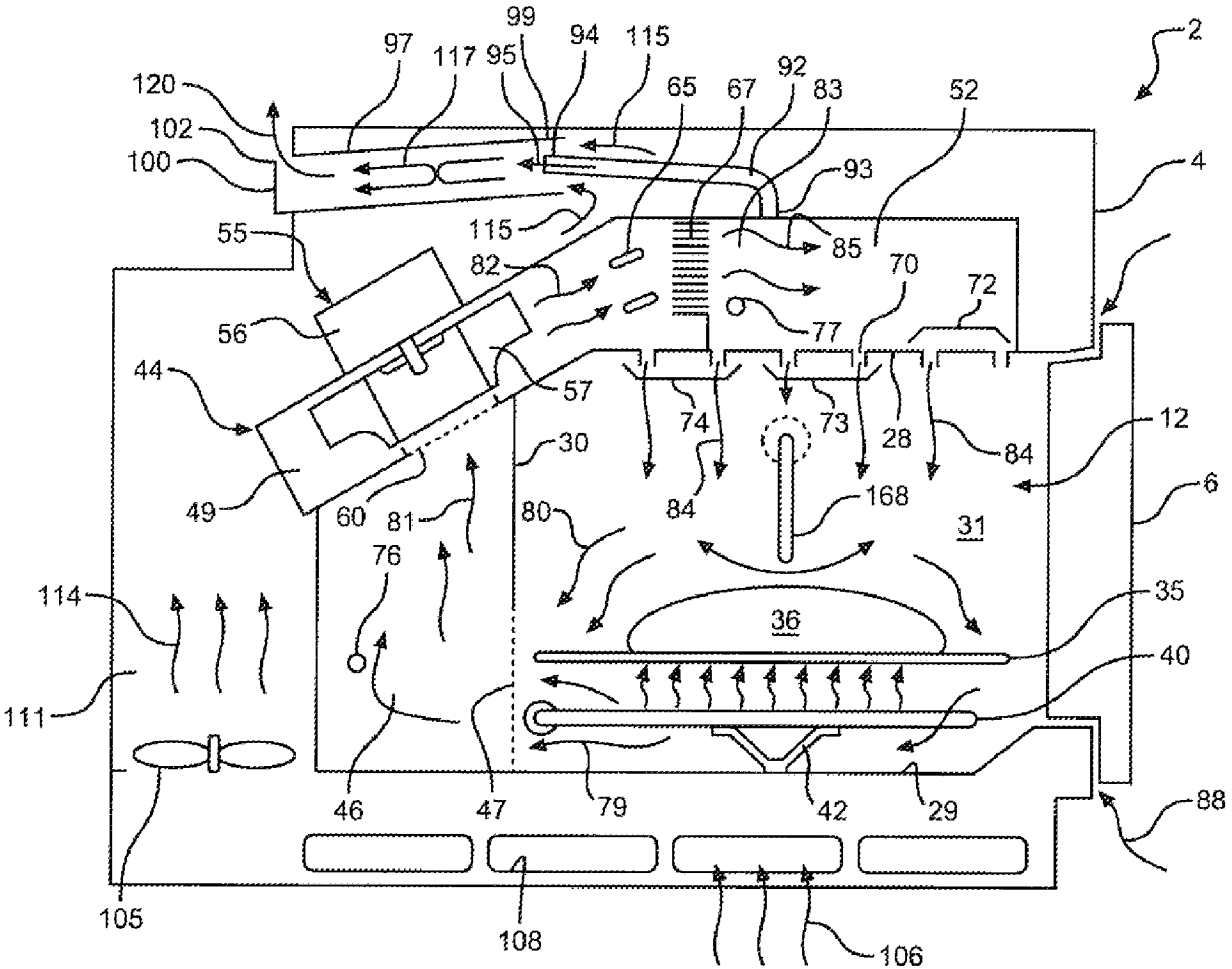
FIG. 2 is a schematic side view of the cooking appliance constructed in accordance with the present invention.

As perhaps best illustrated in the schematic side view of FIG. 2, oven cavity 12 includes top, bottom, rear and opposing side walls 28-31. Mounted within oven cavity 12 is an oven rack 35 which, in the preferred embodiment, constitutes a metal wire rack used to support a food item 36 during cooking. The use of a metal wire rack is desired in order to allow effective air flow around food item 36, while also providing a fairly open support area such that the food item 36 can be radiantly heated from below. As depicted, oven rack 35 is spaced from bottom wall 29 to allow for a sufficient volume of air to flow past the food item 36 such that convection heating can be utilized for both the top and bottom of the food item 36, while also promoting even browning on both the top and bottom. Arranged between oven rack 35 and bottom wall 29 is a radiant heating element 40. More specifically, a support 42 is provided to retain radiant heating element 40 at a substantially intermediate position between bottom wall 29 and oven rack 35. In the most preferred embodiment shown, a single radiant heating element 40 is employed, with radiant heating element 40 being constituted by a sheathed, resistive-type heating element. However, at this point, it should be recognized that multiple radiant heating elements of varying designs can be employed in connection with the invention.

Extending about at least the rear and upper portions of oven cavity 12 is an air plenum 44. More specifically, air plenum 44 includes a return plenum portion 46 which is arranged behind and at least partially defined by rear wall 30. Rear plenum portion 46 has associated therewith an air intake 47 which is defined by a plurality of spaced openings located in rear wall 30 of oven cavity 12. In the most preferred embodiment shown, the plurality of openings extend from above rack 35 to below radiant heating element 40. Air plenum 44 also includes a blower plenum portion 49 and a discharge plenum portion 52. Mounted in blower plenum portion 49 is a blower 55 that includes an electric motor 56 and a fan or impeller unit 57. Blower plenum portion 49 is in fluid communication with return plenum portion 46 through a plurality of openings 60 which leads to a central intake portion of fan unit 57.

Downstream of blower 55, essentially at the juncture of blower plenum portion 49 and discharge plenum portion 52, is a convection heating element 65. Although convection heating element 65 can take various forms, it is preferred to employ a sheathed electric heating unit. Mounted directed adjacent convection heating element 65 is a catalyst unit 67. In a manner known in the art, catalyst unit 67 functions to chemically breakdown airborne byproducts associated with cooking operations. Given the relative position between convection heating element 65 and catalyst unit 67, convection heating element 65 advantageously functions to heat catalyst unit 67 and maintain its temperature at or above a minimum temperature required for proper function of the catalyst.

As clearly shown in these figures, discharge plenum portion 52 is provided with a plurality of nozzles 70 which are spaced along top wall 28 and fluidly interconnect discharge plenum portion 52 with oven cavity 12. In the preferred embodiment shown, the plurality of nozzles 70 are essentially grouped in a first or foremost region 72, a second or intermediate region 73, and a third or aft region 74. As depicted, a portion of the plurality of nozzles 70 located in third region 74 are located prior to catalyst 67, while the remainder of the plurality of nozzles 70 at each of first, second and third regions 72-74 are arranged downstream of catalyst 67. For use in connection with controlling operating temperatures within oven cavity 12, a first temperature sensor 76 is provided within return plenum portion 46 and a second temperature sensor 77 is provided within discharge plenum portion 52. In the most preferred embodiment shown, second temperature sensor 77 is provided directly adjacent catalyst unit 67. As the manner in which heating elements 40 and 65 are controlled to establish and maintain a desired temperature within oven cavity 12 is not part of the present invention, it will not be further discussed herein. Instead, reference is made to copending U.S. patent application Ser. No. 12/681,956 entitled "Temperature Control for Cooking Appliance Including Combination Heating System" filed on Oct. 9, 2008 and incorporated herein by reference.

With the above arrangement, operation of blower 55 will create a circulating air flow into and out of oven cavity 12. More specifically, a return flow constituted by a lower flow 79 going below oven rack 35 and an upper flow 80 going over food item 36 will be drawn in to return plenum portion 46 through the plurality of openings 47 of the air intake. This return air, generally indicated at 81, will flow by first temperature sensor 76 and be directed into fan unit 57 through openings 60. Through operation of fan unit 57, the return air flow 81 will be redirected radially outwardly as convection air stream 82. Air stream 82 will be heated upon flowing across convection heating element 65, with a portion of the convection air stream 82 flowing directly into oven cavity 12 at the various nozzles 70 (see air streams 84) arranged in third region 74 prior to catalyst 67, while a majority of the air flow will flow across catalyst 67 as indicated at 85. The air stream 85 will then flow through the remainder of the plurality of nozzles 70 in the first-third regions 72-74 and back into oven cavity 12, with the air flowing around food item 36 prior to the flow cycle being repeated.

In accordance with the most preferred embodiment of the invention, oven cavity 12 is not completely sealed. Instead, during operation of cooking appliance 2, a low pressure is established within oven cavity 12 and a certain amount of ambient air is drawn into oven cavity 12 around door 6, as indicated at 88. In addition to providing a certain amount of fresh air for the cooking operation, the ambient air stream 88 advantageously functions to reduce door temperature. Based on the desire to allow ambient air 88 into oven cavity 12, cooking appliance 2 also employs an exhaust system wherein a small amount of the generally recirculated air is exhausted. More specifically, the exhaust system includes an exhaust tube 92 having a first end 93 opening up into discharge plenum portion 52 and a second end 94 which terminates at a predetermined location within cavity 4. With this arrangement, the recirculated air utilized for cooking has a portion thereof which is lead into exhaust tube 92 so as to define a cooking exhaust stream generally indicated at 95. The overall exhaust system also includes an exhaust mixing tube 97 having a first end 99 which preferably encompasses and yet is radially spaced from second end 94 of exhaust tube 92. That is, first end 99 of exhaust mixing tube 97 preferably has an enlarged diametric dimension relative to second end 94 of exhaust tube 92, with exhaust mixing tube 97 also having associated therewith a second end 100 having an upwardly opening exit 102.

Also included in connection with cooking appliance 2 is a cooling system arranged within cabinet 4. More specifically, a cooling fan 105 is mounted behind return plenum portion 46. Operation of cooling fan 105 functions to draw a flow of cooling air 106 into cabinet 4, such as through cabinet openings 108. The cooling air 106 is directed by cooling fan 105 through a rear chamber 111 to establish a cooling exhaust stream indicated at 114. Cooling exhaust stream 114 flows about and cools motor 56, as well as various electronic components (not shown), and then around second end 94 of exhaust tube 92 as indicated at 115. This cooling exhaust stream 115 then flows into exhaust mixing tube 97 at first end 99 and mixes with cooking exhaust stream 95 to establish a mixed exhaust stream indicated at 117. Actually, the provision for the cooling air flow creates an elevated pressure in cabinet 4, about oven cavity 12. The cooling exhaust stream 115 flows at a relatively high speed into exhaust mixing tube 97 such that a suction is created which draws cooking exhaust stream 95 into exhaust mixing tube 97. Mixed exhaust stream 117 is then lead through exhaust mixing tube 97 and out upwardly opening exit 102 as a final exhaust 120. Further details of the air flow arrangement can be found in copending U.S. patent application Ser. No. 12/681,948 entitled "Air Circuit for Cooking Appliance Including Combination Heating System" filed on even date herewith Oct. 9, 2008 and incorporated herein by reference.

Figure 3:
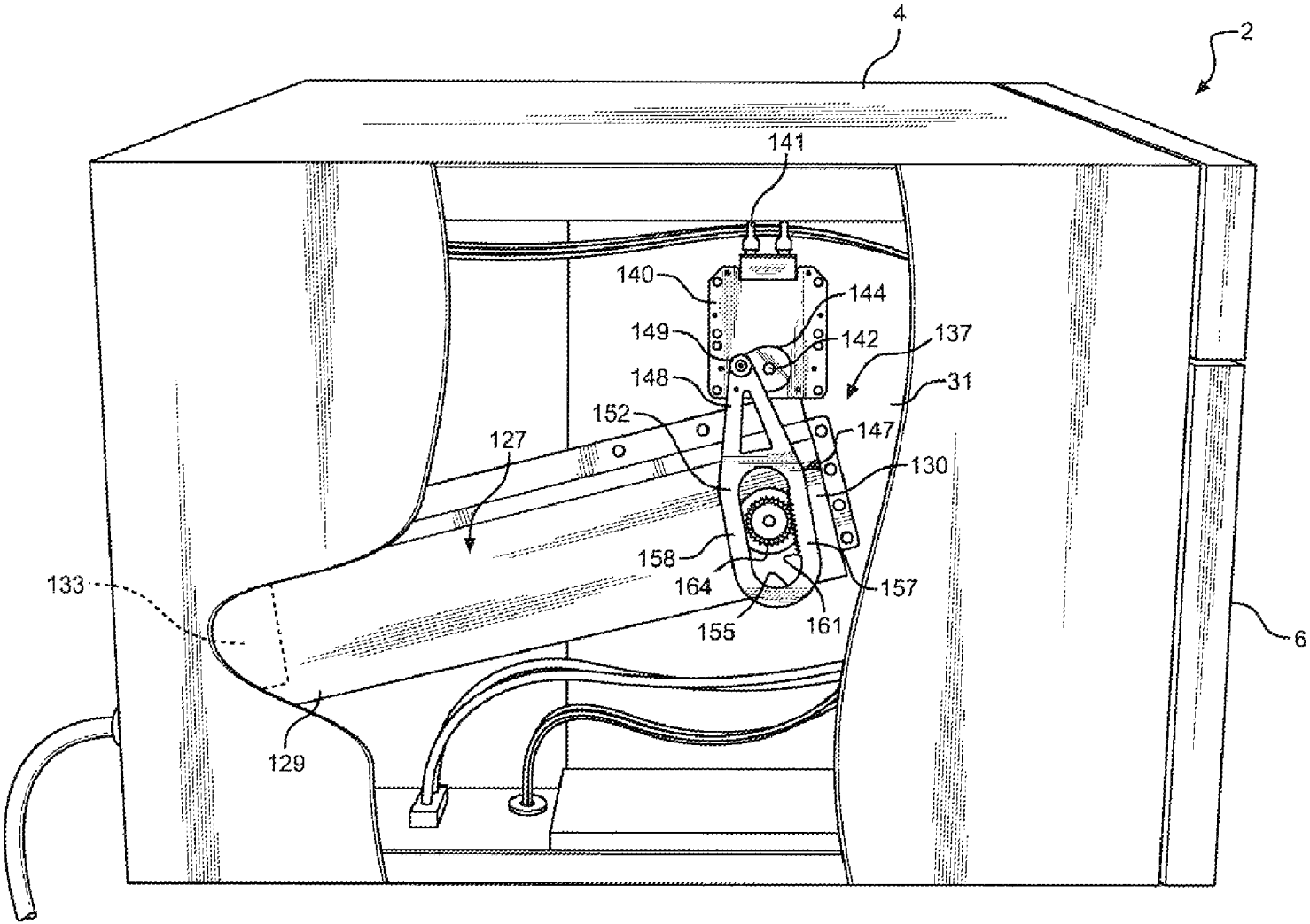
FIG. 3 is partial cut-out side view of the cooking appliance of FIG. 1.

With the arrangement discussed above, cooking appliance 2 can be employed to cook food items utilizing both radiant and convection cooking techniques. However, it is also desired to further incorporate microwave cooking techniques. To this end, as best shown in FIG. 3, cooking appliance 2 is also provided with a pair of wave guides mounted along opposing side walls 31, with one of the waveguides being indicated at 127. Basically, the arrangement on each side of oven cavity 12 is preferably, identically constructed such that reference will be made in detailing one side arrangement. In any case, in connection with the microwave system employed, waveguide 127 includes a first end portion 129 and a second end portion 130. Generically indicated at 133 is a magnetron for generating microwaves which propagate through waveguide 127 and are lead into oven cavity 12. At second end portion 130 is provided a stirrer assembly generally indicated at 137. In the preferred embodiment shown, stirrer assembly 137 includes a motor housing 140 to which is applied electric current through wires 141. Motor housing 140 has associated therewith a rotatable output shaft 142 linked to a mechanism 147 for transferring the rotation of output shaft 142 to a drive member 164. Drive member 164 is fixed for rotation to a rotatable stirrer 168 (see FIG. 2) which is mounted behind a respective side wall 31.

With the above construction, cooking appliance 2 can operate in various modes including: microwave only mode; bake mode; combination bake and convection mode; and full combination mode with microwave, radiant, and hot air convection for high speed food cooking. Instead, reference is made to copending U.S. patent application Ser. No. 12/248,681 entitled "Cooking Appliance Including Combination Heating System" filed on Oct. 9, 2008 and incorporated herein by reference. However, in connection with the present invention, only microwave or combination heating modes employing microwaves is of concern. In particular, the invention is particularly concerned with the manner in which the microwaves are delivered and distributed within oven cavity 12 as will now be detailed.

Figure 4:
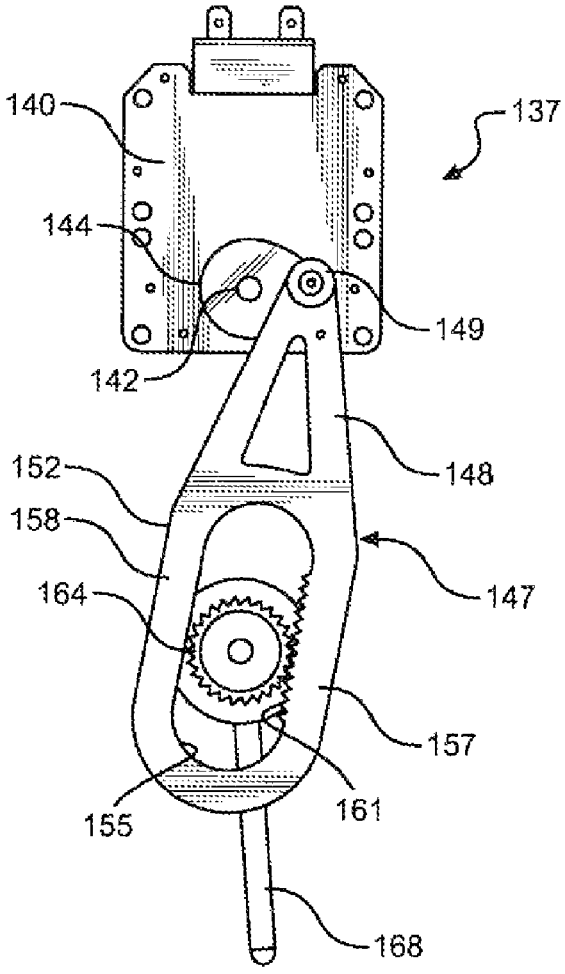
FIG. 4 is a front plan view of a mechanism used to rotate a microwave antenna through a limited angle in accordance with a first embodiment of the invention.
Figure 5:
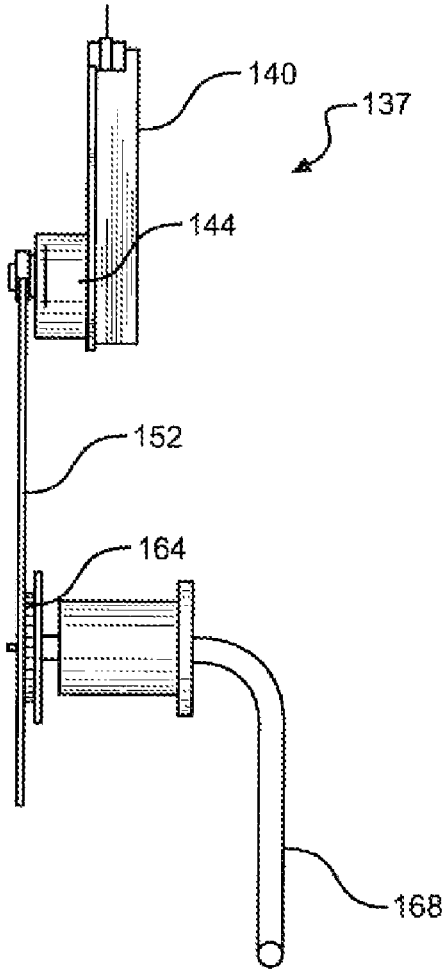
FIG. 5 is a side view of the mechanism of FIG. 4.

In accordance with the invention, each antenna 168 is limited in the degree of rotation such that the antenna 168 only oscillates during operation, preferably through less than or equal to 180° and, most preferably, approximately 150°. Various mechanisms can be utilized to establish the desired oscillating motion. A first embodiment of the present invention will now be discussed with reference to FIGS. 3-5. As shown, transfer device or mechanism 147 has a first end portion 148 that is rotatably attached to a crank arm 144 through a pin joint connection 149. Transfer mechanism 147 also includes a second end portion 152 that is shown to be somewhat oval in shape. Second end portion 152 has a central cut-out 155 defined, at least in part, by elongated side walls 157 and 158. Arranged along interior of central cut-out 155, along one or more of elongated side walls 157 and 158, is a rack gear 161. Preferably, rack gear 161 is only provided on side wall 157, while side wall 158 establishes a smooth slide surface along the interior of central cut-out 155. As shown, rack gear 161 is interengaged through teeth (not separated labeled) to drive member 164 which takes the form of a pinion gear. Pinion gear 164 is fixed for rotation to antenna 168.

In the most preferred embodiment, the overall microwave system is designed to introduce microwaves from both of opposing side walls 31 at a position close to top wall 28, thereby assuring that the microwave energy is introduced from above food item 36 and reducing the potential of any microwave energy being blocked by a pan. This arrangement is considered to at least facilitate the use of metal pans by introducing the microwave energy at a higher location into oven cavity 12 wherein the metal pans will not block the microwave energy from reaching the food load. In any case, the antennae 168 provided on side walls 131 further enhance the distribution of the microwaves for oven cavity 12.

In operation, the motor (not labeled) in motor housing 140 is actuated to rotate output shaft 142, thereby causing crank arm 144, which is fixed for rotation with output shaft 142 to also rotate. Due to the connection of mechanism 147 to crank arm 144 through pin joint connection 149, the rotation of crank arm 144 drives rack gear 161 in a mainly linear fashion. With the teeth of pinion gear 164 being interengaged with the teeth of rack gear 161, shifting of rack gear 161 is translated into rotation of pinion gear 164, as well as rotation of antenna 168. In other words, as crank arm 144 rotates, rack gear 161 traces a circular path where it is connected to crank arm 144, while the other end of rack gear 161 maintains tangency with pinion gear 164. As rack gear 161 reciprocates with the complete rotation of output shaft 142 and crank arm 144, pinion gear 164 will only partially rotate, thereby causing antenna 168 to oscillate. As indicated above, antenna 168 preferably only oscillates through less than or equal to 180° and, most preferably, approximately 150°.

It should be realized that, for each position of antennae 168 along its operational path, there is a unique mode pattern created. With testing it has been found that certain positions create more favorable mode patterns exemplified by fast and even heating, while others create unfavorable mode patterns and exhibit slow heating, hot and cold spots and potential arcing. By controlling antennae 168 to oscillate in accordance with the invention, it has been found that the most favorable modes can be achieved for the microwave system. This improves the overall microwave performance and reduces problems associated with the unfavorable mode patterns, particularly at the height of rack 35. In the preferred embodiment wherein antennae 168 rotate through 180°, each antenna 168 is rotated relative to side walls 31 through 90° in each direction to establish a semi-circular pattern during oscillation which advantageously allows for taller metal pans to be used without arcing between the metal pan and the antennae. However, depending on the particular cooking operation being performed, the range of oscillation can be altered, i.e., reduced below the 180° range to establish unique mode patterns. In addition, the invention provides for a relatively uniform oscillation speed over the entire range of motion, which is important for proper microwave distribution.

At this point, it should be noted that, although pinion gear 164 is illustrated as having teeth extending around the entire periphery thereof, the teeth need only extend about the desired angle of oscillation. For instance, it is possible to only have the teeth on 150-180° of the outer periphery and to provide a smooth surface on the remainder of the periphery. In such an arrangement, the smooth section of the pinion gear 164 would preferably slide or slip along side wall 158 to keep the teeth of both pinion gear 164 and rack gear 161 in proper engagement. It is also possible to provide a corresponding rack on side wall 158 such that pinion gear 164 engages on opposing diametric portions.

Although described with reference to a preferred embodiment of the invention, it should be readily understood that various changes and/or modifications can be made to the invention without departing from the spirit thereof. In particular, it should be realized that various different drive arrangements, including numerous rotary to linear drive transmitting devices or linear drive devices, could be employed to establish the desired oscillating movement of the antennae and, consequently, the improved microwave performance and enhanced mode patterns. In general, the invention is only intended to be limited by the scope of the following claims.

We claim:

1. In a cooking appliance including an oven cavity having top, bottom and opposing first and second side walls into which a microwave system delivers microwaves during a cooking operation, with the microwave system including an antenna for propagating the microwaves, a method of rotating the antenna comprising:

activating a drive motor to rotate a crank arm;

transferring movement of the crank arm to a transfer member, which defines a rack gear, to cause the rack gear to travel with reciprocal movement;

transferring the reciprocal movement of the rack gear to oscillating, rotary movement of a pinion gear which is interengaged with the rack gear and drivingly connected to the antenna; and rotatably oscillating the antenna with the oscillating, rotary movement of the pinion gear.

2. The method of claim 1, wherein the antenna oscillates through no more than 180°.

3. The method of claim 2, wherein the antenna oscillates through approximately 150°.

4. A method of operating a microwave cooking system of a cooking appliance including a cabinet within which is arranged an oven cavity including top, bottom, rear and opposing side walls comprising:

activating first and second microwave generators for developing microwaves for a cooking operation in the oven cavity;

introducing the microwaves into the oven cavity through first and second waveguides extending along the opposing side walls, with a respective one of the first and second microwave generators developing microwaves at a first end portion of a respective one of the first and second waveguides and the microwaves being introduced into the oven cavity at a second end portion of the respective one of the first and second waveguides;

activating a pair of drive motors to rotate a pair of crank arms;

transferring movement of the pair of crank arms to a pair of transfer members, each of which defines a rack gear; and rotatably oscillating first and second antennae positioned at the opposing side walls of the oven cavity, respectively, with the movement of a respective said rack gar to distribute the microwaves from the first and second microwave generators during the cooking operation.

5. The method of claim 4, further comprising: directing the microwaves downward from the first end portion to the second end portion of each of the first and second waveguides such that the second end portion of each of the first and second waveguides is located closer to the top wall of the oven cavity.

6. The method of claim 4, wherein the first and second antennae oscillate through no more than 180°.

7. The method of claim 6, wherein the first and second antennae oscillate through approximately 150°.

8. A method of operating a microwave cooking system of a cooking appliance including a cabinet, within which is arranged an oven cavity including top, bottom, rear and opposing side walls, and a door for selectively accessing the oven cavity comprising:

developing microwaves which are introduced into the oven cavity during a cooking operation; and oscillating an antenna assembly to distribute the microwaves within the oven cavity during the cooking operation by:

activating a drive motor to rotate a crank arm;

transferring movement of the crank arm to a first end portion of a transfer member in order to cause a second end portion of the transfer member, which defines a rack gear, to reciprocate;

rotating a pinion gear interengaged with the rack gear;

rotatable oscillating an antenna, which is attached to the pinion gear, relative to one of the opposing side walls of the oven cavity.

9. The method of claim 8, further comprising: introducing the microwaves into the oven cavity through a waveguide extending along one of the opposing side walls, with the microwaves being introduced at a first end portion of the waveguide, delivered to a second end portion of the waveguide and introduced into the oven cavity at the second end portion.

10. The method of claim 9, wherein the antenna oscillates through no more than 180°.

11. The method of claim 10, wherein the antenna oscillates through approximately 150°.

* * * * *